US010814209B1

(12) United States Patent
Carlton

(10) Patent No.: US 10,814,209 B1
(45) Date of Patent: Oct. 27, 2020

(54) ATHLETIC STRIKING MITTS

(71) Applicant: Bradley H. Carlton, Tucson, AZ (US)

(72) Inventor: Bradley H. Carlton, Tucson, AZ (US)

( * ) Notice: Subject to any disclaimer, the term of this patent is extended or adjusted under 35 U.S.C. 154(b) by 0 days.

(21) Appl. No.: 15/286,557

(22) Filed: Oct. 5, 2016

Related U.S. Application Data

(60) Provisional application No. 62/237,389, filed on Oct. 5, 2015.

(51) Int. Cl.
*A63B 71/14* (2006.01)
*A63B 69/26* (2006.01)

(52) U.S. Cl.
CPC ..... *A63B 71/141* (2013.01); *A63B 69/26* (2013.01)

(58) Field of Classification Search
CPC ..... A63B 69/26; A63B 69/00; A63B 69/20; A63B 69/24; A63B 71/14; A63B 71/141; A63B 71/143; A63B 71/145; A63B 2071/0063; A63B 69/0002; A63B 69/0004; A63B 69/0006; A63B 69/0008; A63B 2244/102; A63B 2244/104; A63B 2244/106; A41D 19/0006; A41D 19/0041; A41D 19/0051; A41D 19/01523; A41D 13/08; A41D 13/081; A41D 13/082; A41D 13/084; A41D 19/00
USPC ..... 2/20, 161.1; 482/88; D29/113, 116.1, D29/118
See application file for complete search history.

(56) References Cited

U.S. PATENT DOCUMENTS 447,233 A * 2/1891 Decker ..... A63B 71/143 2/19
461,847 A * 10/1891 Price ..... A63B 71/143 2/19
528,343 A * 10/1894 Rogers ..... A63B 71/143 2/19
540,514 A * 6/1895 Rogers ..... A63B 71/143 2/19
550,949 A * 12/1895 Decker ..... A63B 71/143 2/19
780,306 A * 1/1905 Rogers ..... A63B 71/143 2/19

(Continued)

FOREIGN PATENT DOCUMENTS

CN 2122503 U 11/1992
CN 2803462 Y 8/2006
CN 201346387 Y 11/2009

OTHER PUBLICATIONS

Tigon Sports, "No Mercy" Focus Pads, http://www.tigonsports.com/focus-pads/no-mercy-focus-pads-red, from Sep. 28, 2015, captured Jul. 10, 2018.*

(Continued)

*Primary Examiner* — Heather Mangine
(74) *Attorney, Agent, or Firm* — Booth Udall Fuller, PLC

(57) ABSTRACT

An athletic striking mitt is disclosed used in training athletes in boxing, martial arts, and other sports. The athletic striking mitt includes a back pad that increases the number of creative striking combinations available to the striker and reduces the repetitive stress common to the wrist, elbow, and shoulder of the trainer. An athletic striking mitt may include a glove assembly having a palm side and a back side, a front pad coupled to the palm side of the glove assembly, and a back pad coupled to the back side of the glove assembly. The glove assembly is sandwiched between the front pad and the back pad.

5 Claims, 12 Drawing Sheets

(56) References Cited

U.S. PATENT DOCUMENTS 805,538 A * 11/1905 Goldsmith ..... A63B 71/143 2/19
972,224 A * 10/1910 Pease ..... A63B 71/145 2/18
1,562,176 A * 11/1925 Latina ..... A63B 71/143 2/19
1,767,115 A * 6/1930 Berry ..... A63B 71/143 2/19
2,952,021 A * 9/1960 Finn ..... A63B 71/148 2/20
3,741,207 A * 6/1973 Fuson ..... A61F 13/104 128/879
3,896,497 A * 7/1975 Rhee ..... A63B 71/145 2/20
4,417,359 A * 11/1983 Johnson ..... A63B 71/145 2/16
4,700,404 A * 10/1987 Potvin ..... A63B 71/143 2/16
4,967,418 A * 11/1990 Marcotte ..... A63B 71/143 2/16
4,991,231 A 2/1991 Swift
5,083,314 A * 1/1992 Andujar ..... A63B 71/145 2/16
5,136,725 A * 8/1992 Montero ..... A63B 71/148 2/16
5,257,418 A * 11/1993 Jaskiewicz ..... A41D 19/01523 2/161.1
5,373,584 A * 12/1994 Parcells, III ..... A41D 13/0153 2/465
5,511,243 A * 4/1996 Hall ..... A63B 71/143 2/16
5,604,934 A * 2/1997 Willett ..... A41D 19/01547 2/161.1
D385,667 S * 10/1997 Goldsmith ..... D29/116.3
6,226,795 B1 * 5/2001 Winningham ..... A41D 13/084 2/20
D547,011 S * 7/2007 Schouten ..... D29/118
8,287,437 B1 * 10/2012 Rovere ..... A63B 69/004 473/444
9,320,954 B1 * 4/2016 Simpkins ..... A63B 69/004
2009/0126058 A1 * 5/2009 Loos ..... A41D 19/01505 2/2.5
2012/0159681 A1 6/2012 Gibby
2014/0371007 A1 * 12/2014 Marciano ..... A63B 69/0026 473/446

OTHER PUBLICATIONS

GelTech, Cobra Curved Punch Spar-Mitt 3.0, accessed May 22, 2019, oldest review date May 22, 2013, https://www.amazon.com/GelTech-Curved-Spar-Mitt-Kickboxing-Martial/dp/B005ESPOPI?ref_=fsper_pl_dp_13_2368119011#customerReviews (Year: 2013).*

* cited by examiner

ATHLETIC STRIKING MITTS

CROSS REFERENCE TO RELATED APPLICATION

This application claims the benefit of the filing date of U.S. Provisional Patent Application 62/237,389 entitled "ATHLETIC STRIKING MITTS" to Bradley H. Carlton, filed on Oct. 5, 2015, the disclosure of which being hereby incorporated entirely herein by reference.

BACKGROUND

1. Technical Field

Aspects of this document relate generally to athletic striking mitts.

2. Background Art

In boxing and other martial arts, conventional striking mitts are used as training and exercise devices. Typically, an athlete will hit conventional mitts worn by a trainer. Conventional mitts for boxing, for example, have only a padded area in front of a trainer's palm placed in a glove integrated with the padded area.

SUMMARY

According to one aspect, a striking mitt may include a glove assembly having a palm side and a back side. A front pad may be coupled to the palm side of the glove assembly, the front pad having a front striking surface. A back pad may be coupled to the back side of the glove assembly, the back pad having a back striking surface.

Implementations may comprise one or more or all of the following.

The back striking surface may have an area between 40% and 100% as large as the area of the front striking surface.

The glove assembly may further include a glove coupled to a rear surface of the front pad, and a flexible bridge member having a first edge portion and a second edge portion opposite the first edge portion. The palm side of the glove assembly may include the first edge portion and the back side of the glove assembly may include the second edge portion.

The flexible bridge member may attach the front pad to the back pad without attaching the back pad to the glove.

The glove assembly may further include a protrusion beneath a palm or finger portion of the glove, the protrusion protruding from the rear surface of the front pad towards the back pad, wherein the protrusion has a diameter of between 0.8 and 4.5 inches and a maximum protrusion between 0.2 and 1.7 inches. The protrusion may include a hemisphere of a ball.

The front striking surface may be a different color than the back striking surface.

The striking mitt may further include a front visual target coupled to the front striking surface; and a back visual target coupled to the back striking surface. The front visual target may be a different shape and/or color than the back visual target.

According to another aspect, a striking mitt may include a glove assembly having a glove and a flexible bridge member, the flexible bridge member having a palm side and a back side. A front pad may be coupled to the palm side of the bridge member and the glove, the front pad having a front striking surface. A back pad may be coupled to the back side of the bridge member, the back pad having a back striking surface.

Implementations may comprise one or more or all of the following.

The striking mitt may further include an adjustable wrist strap coupled to a rear surface of the front pad.

The bridge member may attach the front pad to the back pad without attaching the back pad to the glove.

The back striking surface may have an area between 40% and 90% as large as the area of the front striking surface.

The striking mitt may further include a front visual target coupled to the front striking surface, and a back visual target coupled to the back striking surface.

According to yet another aspect, a striking mitt may include a glove assembly having a glove and a flexible bridge member, the flexible bridge member having a palm side and a back side. A front pad may be coupled to the palm side of the bridge member and the glove, the front pad having a front striking surface. A back pad may be coupled to the back side of the bridge member, the back pad having a back striking surface having an area between 40% and 100% as large as the area of the front striking surface.

Implementations may comprise one or more or all of the following.

The bridge member may attach the front pad to the back pad without attaching the back pad to the glove.

The back striking surface may have an area between 50% and 80% as large as the area of the front striking surface.

The striking mitt may further include an adjustable wrist strap coupled to a rear surface of the front pad.

The striking mitt may further include a front visual target coupled to the front striking surface, and a back visual target coupled to the back striking surface. The front visual target may be a different shape and/or color than the back visual target.

The front striking surface may be a different color than the back striking surface.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Aspects and implementations will hereinafter be described in conjunction with the appended drawings, where like designations denote like elements, and.

DESCRIPTION

Figure 1:
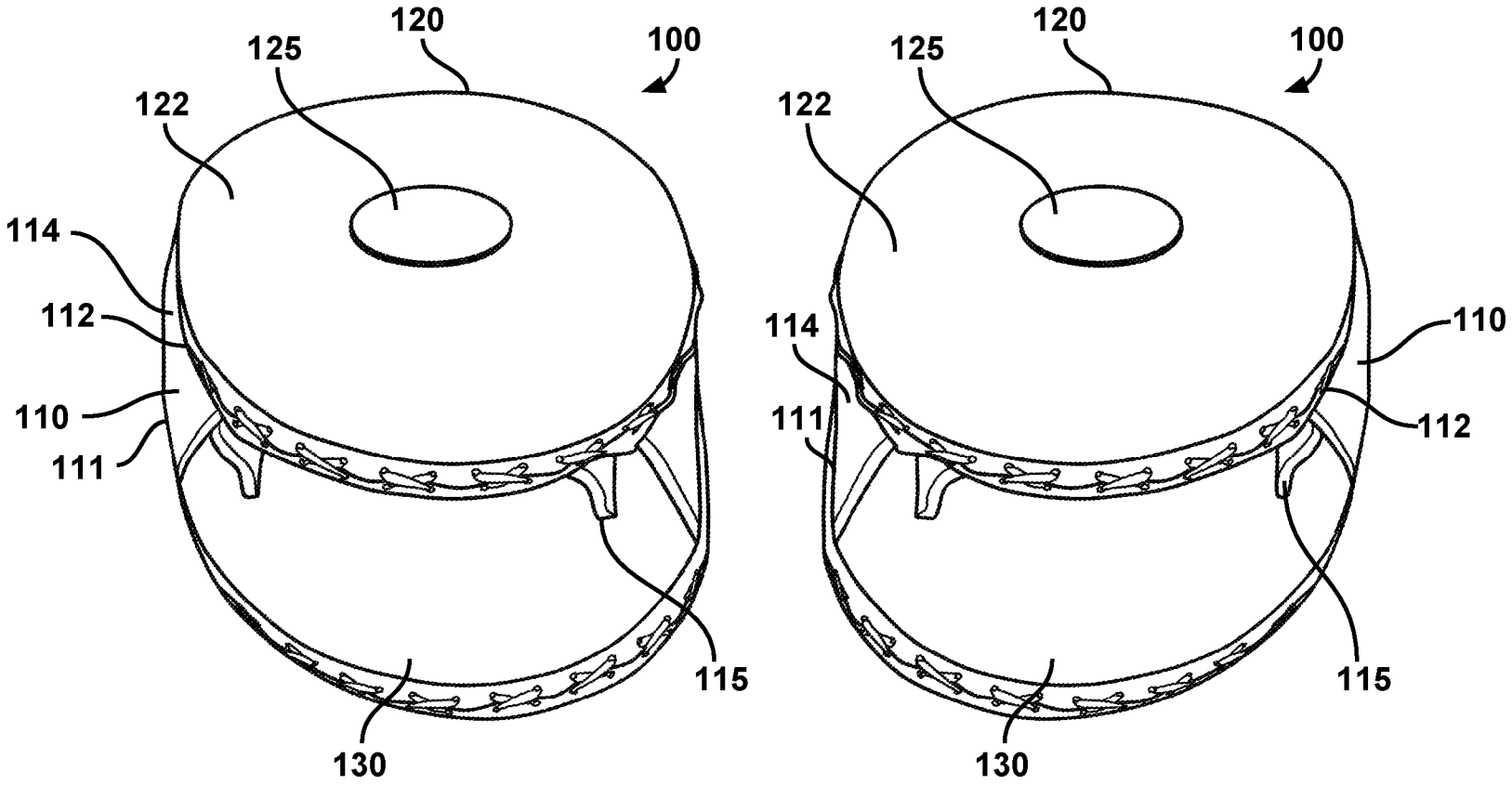
FIG. 1 is a perspective view of a pair of striking mitts.

This disclosure, its aspects and implementations, are not limited to the specific components or assembly procedures disclosed herein. Many additional components and assembly procedures known in the art consistent with the intended athletic striking mitt and/or assembly procedures for an athletic striking mitt will become apparent from this disclosure. Accordingly, for example, although particular athletic striking mitts are disclosed, such athletic striking mitts and implementing components may comprise any shape, size, style, type, model, version, measurement, concentration, material, quantity, and/or the like as is known in the art for such athletic striking mitts and implementing components, consistent with the intended operation of athletic striking mitts.

In the following description, it is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure.

Contemplated in this disclosure are one or more striking mitt devices configured to assist in exercising and training people engaged in athletic endeavors (e.g., boxing, martial arts, aerobic fitness, football, and so forth), for example, at least in a manner similar to conventional striking mitts. Various implementations of the disclosed striking mitt devices and systems may be employed in a wide variety of athletic endeavors in addition to boxing and martial arts, including, but not limited to: self-defense training, combat training, aerobic exercise, football, rugby, soccer, etc., and sports yet to be created involving real or simulated strikes to a body (including both intentional and unintentional strikes). Moreover, references herein to the term "athlete" refer to a person who strikes the trainer wearing the striking mitts, and do not necessarily indicate that the athlete is a professional athlete, a fit person, or has minimum required level of physical fitness or expertise in a sport. Further, references herein to the term "trainer" refer to a person wearing the striking mitts so that the athlete may strike the striking mitts, and do not necessarily indicate that the trainer is a professional trainer, a coach, a sparring partner, or has any minimum required level of physical fitness or expertise in a sport.

The disclosed striking mitt is a far more versatile training and exercising device compared to conventional striking mitts used, for example, in training athletes in boxing or other martial arts (e.g., TaeKwonDo, Karate, Muay Thai, kickboxing, Mixed Martial Arts or "MMA", and so on). A conventional striking mitt in boxing for example is intended to be struck only on the front surface of a front pad, thus striking the conventional mitt only near the trainer's palm rather than having an option to strike the back of the trainer's hand as well.

In contrast, implementations of a striking mitt device according to this disclosure are configured to: provide an improved training experience for both an athlete and trainer, improve striking accuracy for the athlete, and/or improve the safety of the trainer. The disclosed striking mitt allows for versatility common to variations in martial art styles and instruction. Padding both sides for focused striking increases exponentially the amount of creative striking combinations available to the striker and reduces the repetitive stress common to the wrist, elbow, and shoulder of the trainer. Having a more versatile striking surface allows for an improved focused trajectory of strike placement. This new way of striking the pads creates higher levels of accuracy due to the lack of ineffective wrist pronation and other physical limitations to the actual angle needed for a particular strike.

Figure 3:
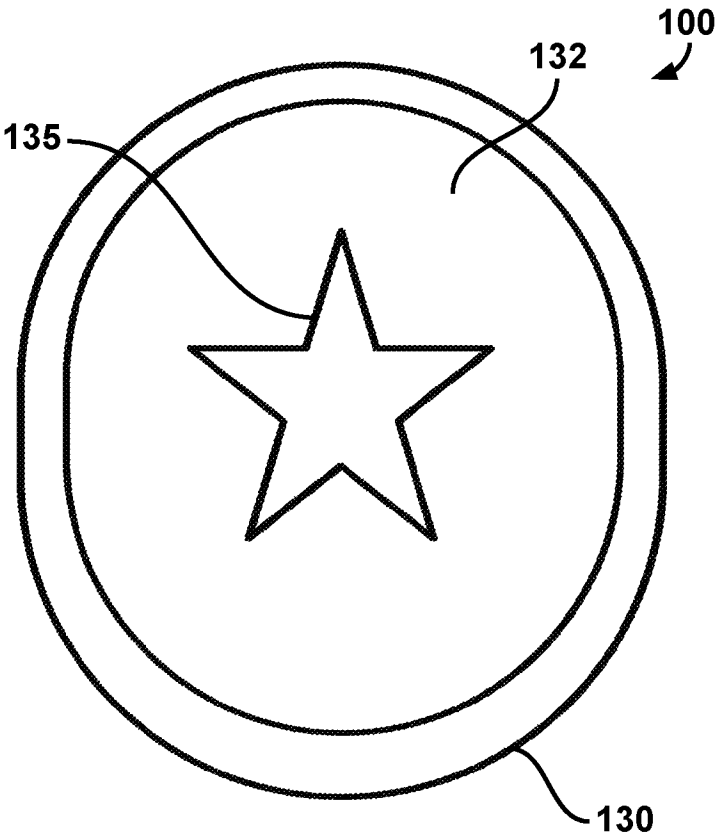
FIG. 3 is a plan view of a front side of a striking mitt.
Figure 2:
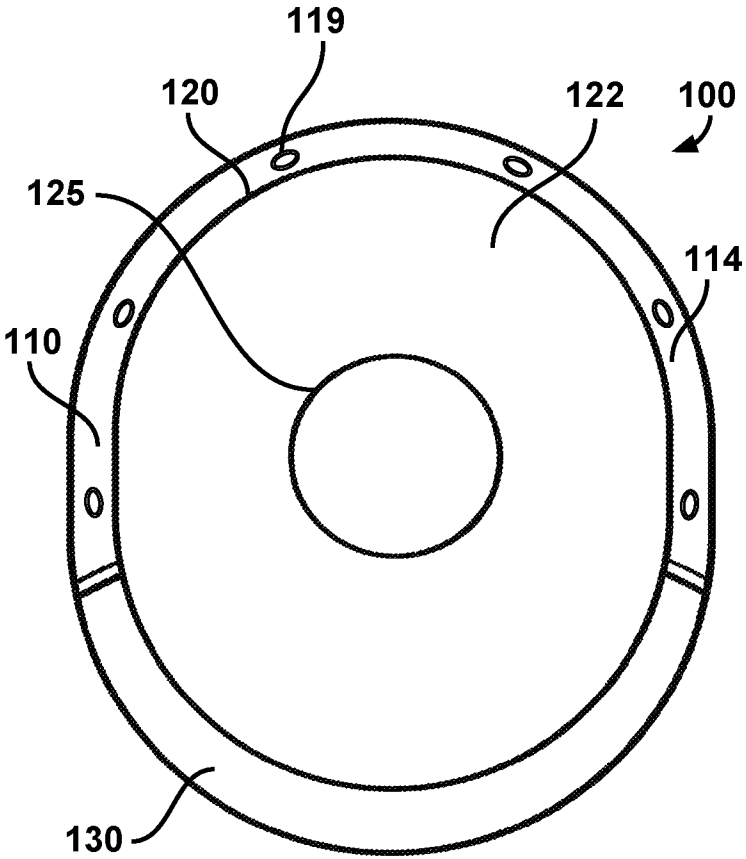
FIG. 2 is a plan view of a back side of a striking mitt.
Figure 4:
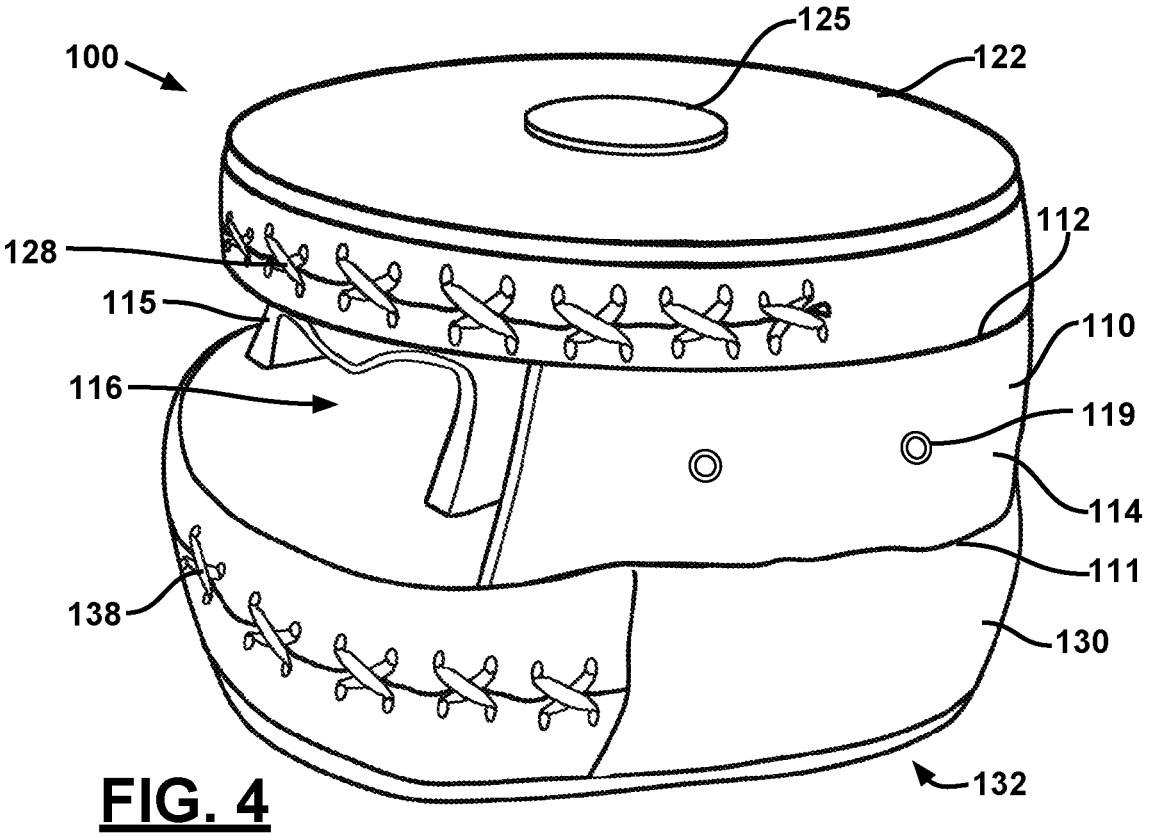
FIG. 4 is a first side perspective view of a striking mitt.
Figure 5:
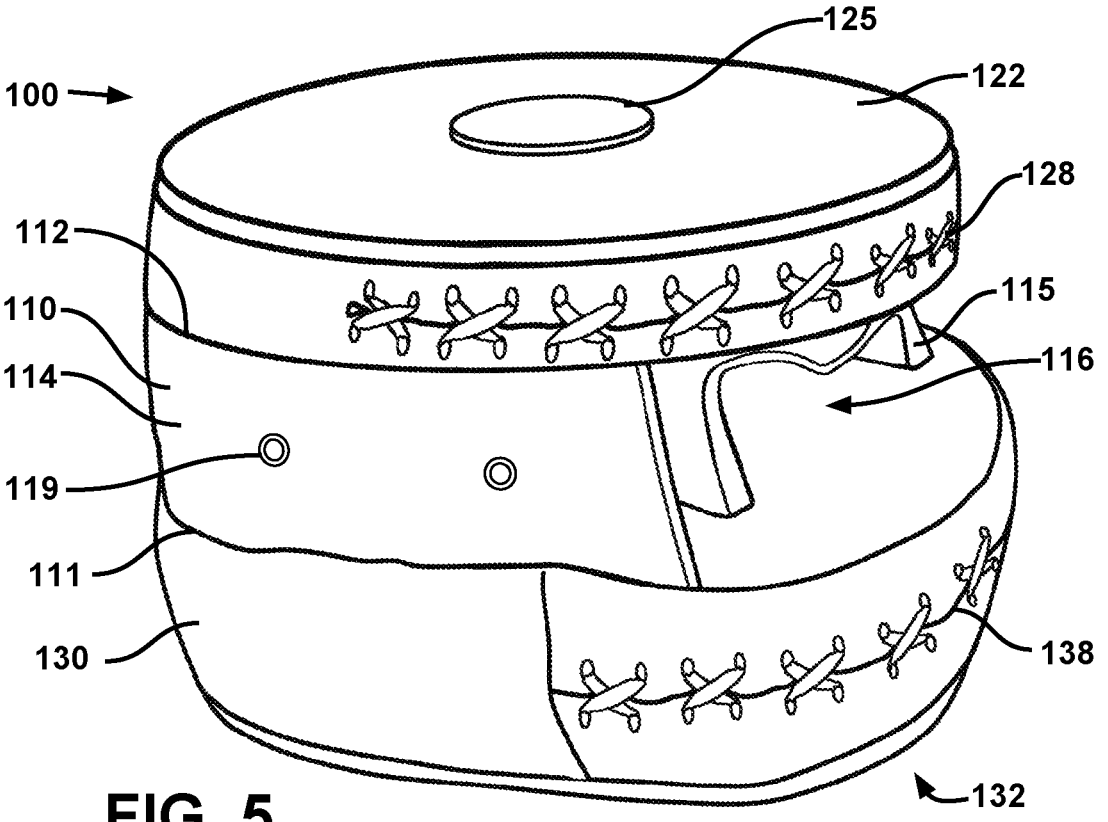
FIG. 5 is a second side perspective view of a striking mitt.
Figure 6:
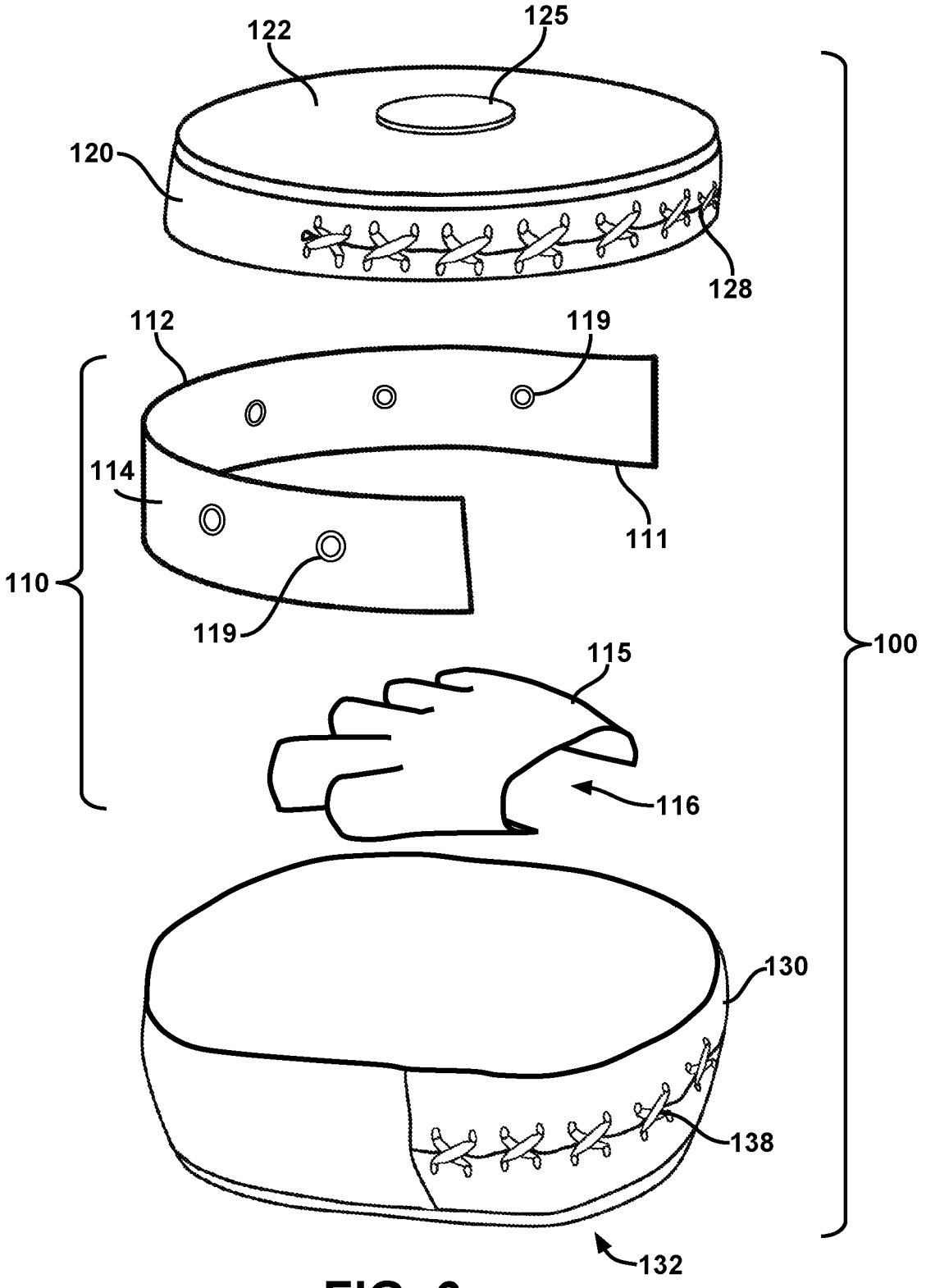
FIG. 6 is an exploded perspective view of a striking mitt.

As depicted in the non-limiting implementations shown in FIGS. 1 to 6, a striking mitt device or system 100 may include a glove assembly 110 having a palm side 111 and a back side 112, a front pad 130 coupled to the palm side 111 of the glove assembly 110, and a back pad 120 coupled to the back side 112 of the glove assembly 110. FIGS. 4 and 5 are two opposite side perspective views of a striking mitt 100 and FIG. 6 is an exploded view of a striking mitt 100 showing how the glove assembly 110 is sandwiched between the front pad 130 and the back pad 120.

The glove assembly 110 may include a glove 115 coupled to a rear surface of the front pad 130 and/or the palm side 111 of the glove assembly 110. The glove assembly 110 may include webbing 114 spanning the gap between the front pad 130 and the back pad 120. One or more breathing holes 119 may be included in the webbing 114 to help air enter and exit to provide cooling, as well as when the glove assembly 110 is compressed during use (e.g., when the striking mitt 100 is struck by an athlete).

FIGS. 4 and 5 show perspective views illustrating an aperture 116 of the glove assembly 110 where the trainer inserts his hand to wear the striking mitt 100 (again, the glove assembly 110 being sandwiched between the front pad 130 and the back pad 120). Padding is housed within each of the front pad 130 and the back pad 120, and may be inserted through a closing assembly that may be configured to open to replace or repair the enclosed padding. For example, closing assembly 128 of the back pad 120 and closing assembly 138 of the front pad 130 may be laced together to hold in the enclosed padding. Closing assemblies 128 and 138 may use a number of different closing or fastening mechanisms (e.g., zippers, hook and loop fasteners, buttons, clasps, latches, seams, etc.), and are not limited to laces as shown. The padding enclosed in back pad 120 and front pad 130 may be any one of a variety of different padding materials, including at least: padding, foam, cotton, plastics, composites, gel, air bladders, air cells, or combinations of the foregoing padding materials.

In some implementations the striking mitt 100 may include one or more visual targets, such as a back target 125 (see circle on the striking surface 122 of the back pad 120 shown in FIG. 1) or a front target 135 (see star shape on the striking surface 132 of the front pad 130 shown in FIG. 3).

Thus, the disclosed striking mitt implementations add many benefits by including at least a back pad 120, which allows an athlete to strike the striking mitt 100 on the striking surface 122 of the back pad 120 (near the back of the trainer's hand) and a trainer to have many options in which to hold the striking mitt 100 to not only improve an athletes shot accuracy but to be safe in the process. Giving the trainer the ability to choose to catch the athlete's strikes with either the front pad 130 or the back pad 120 of the striking mitt 100 greatly improves the location, angle, and variety of strikes the trainer can catch with the striking mitt 100. This improved variability in positioning a striking mitt 100 increases the number of striking combinations available to the athlete, allowing for more creativity in striking combinations to improve the training experience.

Referring still to FIGS. 1-6, the striking mitt 100 comprises a back pad 120 coupled to a backside of the striking mitt 100, for example, near a backside 112 of the glove assembly 110. The back pad 120 may couple to the back side of the striking mitt 100 (e.g., near a backside 112 of the glove assembly 110) using stitching (as shown), adhesives, bonding agents, fabric welds, fasteners, belts, rivets, zippers, lacing, clasps, latches, locks, hook and loop fasteners, snaps, clamps, crimping, taping, gluing, cementing, magnets, heat bonding, lashings, connectors, ties, or other coupling means yet to be developed. The back pad 120 may be fixedly or removably coupled to the backside 112 of glove assembly 110 of the striking mitt 100.

In some implementations the striking mitt 100 may be a double-sided focus-striking mitt that is more versatile than conventional focus type mitts in that it provides for focused striking on both sides of the mitt. Thus, for example, striking mitt 100 may include one or both of back target 125 and/or front target 135. The back target 125 may be removably attached to the striking surface 122 and/or the front target 135 may be removably attached to the striking surface 132.

Specifically, the double-sided striking mitt includes one or more visual targets, such as a back target 125 (see circle on the striking surface 122 of the back pad 120 shown in FIG. 1) and/or a front target 135 (see star shape on the striking surface 132 of the front pad 130 shown in FIG. 3). A visual target 125/135 is configured to provide the athlete with a target to focus or aim his or her strikes at. The visual target 125/135 may include, without limitation: a contrasting color, pattern, shape, or design; an image; a logo; any combination thereof; and the like. The visual target 125/135 may be located on the striking surface 122 of the back pad 120 or on the striking surface 132 of the front pad 130 in a location adapted to minimize the force of the strike and minimize the risk of injury to the trainer. The back target 125 may have a similar or the same shape, color, pattern, design, image, a logo, and/or a combination thereof as the front target 135.

In some implementations, the glove 115 includes dividing partitions between one or more fingers. The glove 115 may include a dividing partition between each finger (including the thumb). The glove 115 may include a dividing partition between several, but not every finger. The glove 115 may include a dividing partition between only two fingers (e.g., just the thumb and the first finger).

In some implementations, the back striking surface 122 has a different color, pattern, design, image, a logo, and/or a combination thereof imprinted thereon, or is otherwise visually distinctive from the front striking surface 132. Having a back striking surface 122 that is visually distinctive from the front striking surface 132 may be employed with or without using visual targets 125/135. In some implementations, the visual targets 125/135 have a similar shape and color, but the back striking surface 122 is visually distinctive from the front striking surface 132.

Figure 7:
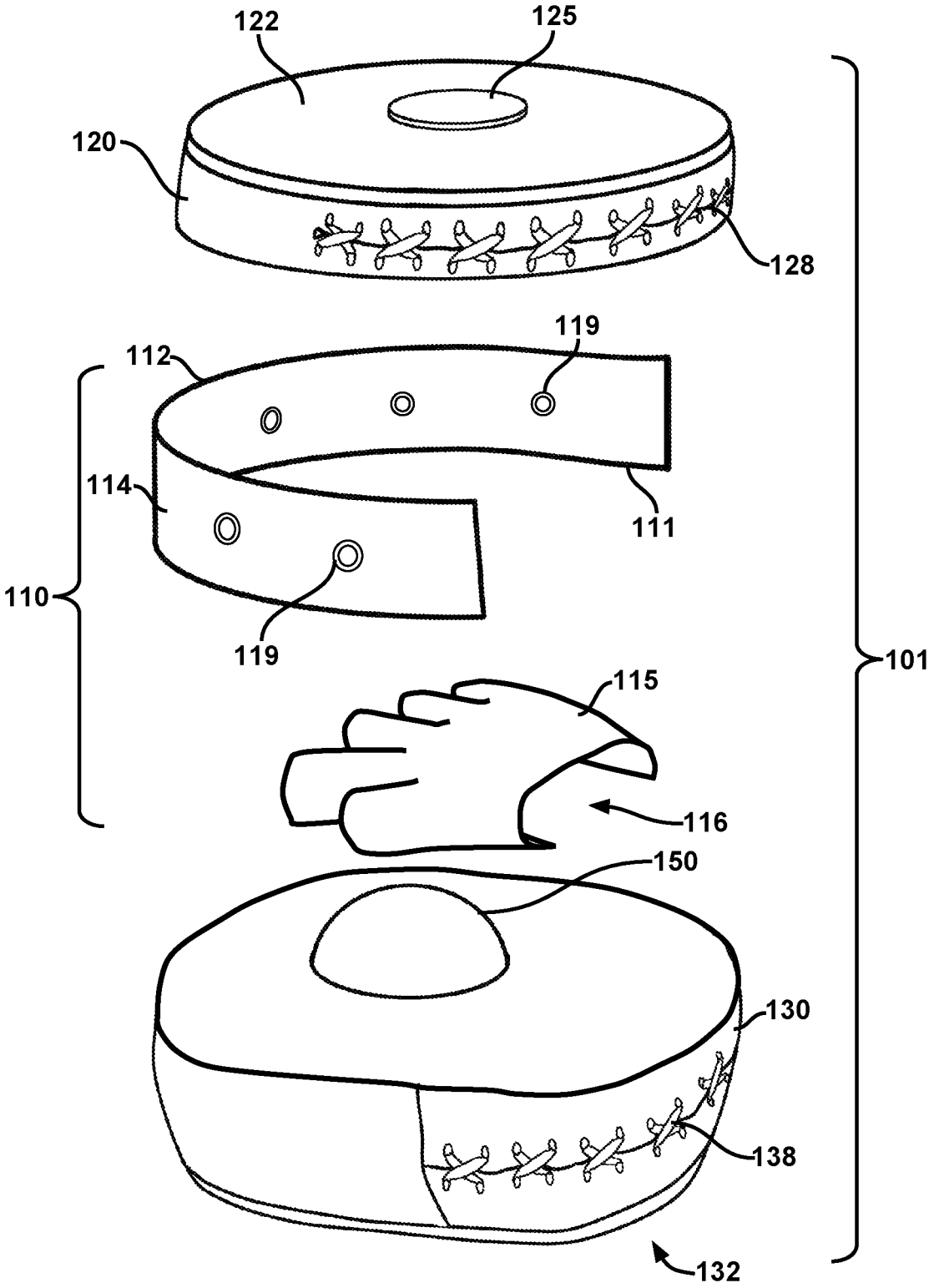
FIG. 7 is an exploded perspective view of a striking mitt.
Figure 8:
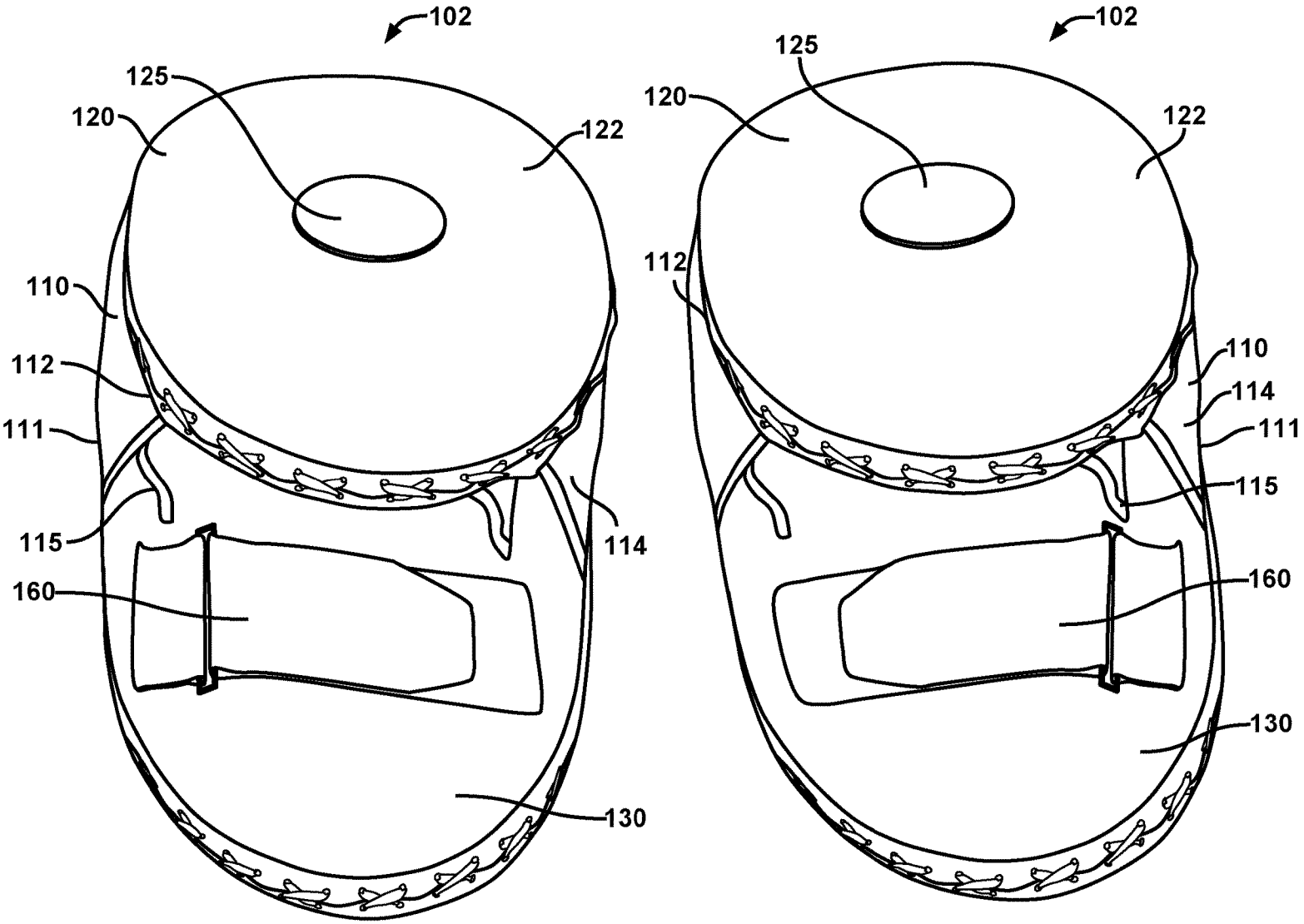
FIG. 8 is a perspective view of a pair of striking mitts.
Figure 10:
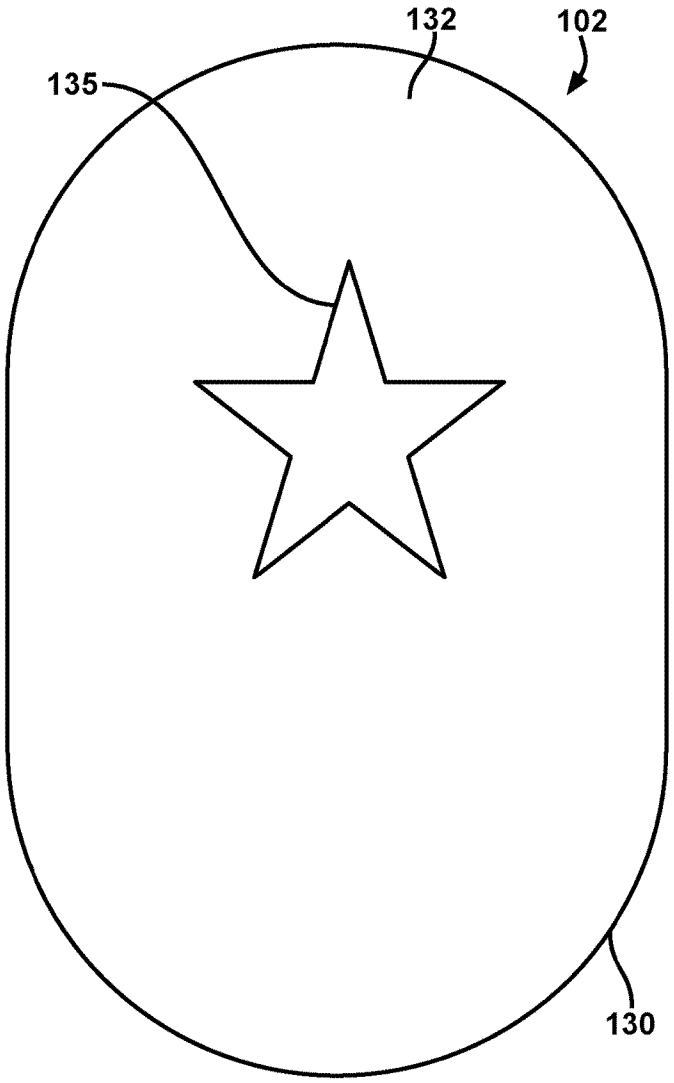
FIG. 10 is a plan view of a front side of a striking mitt.
Figure 9:
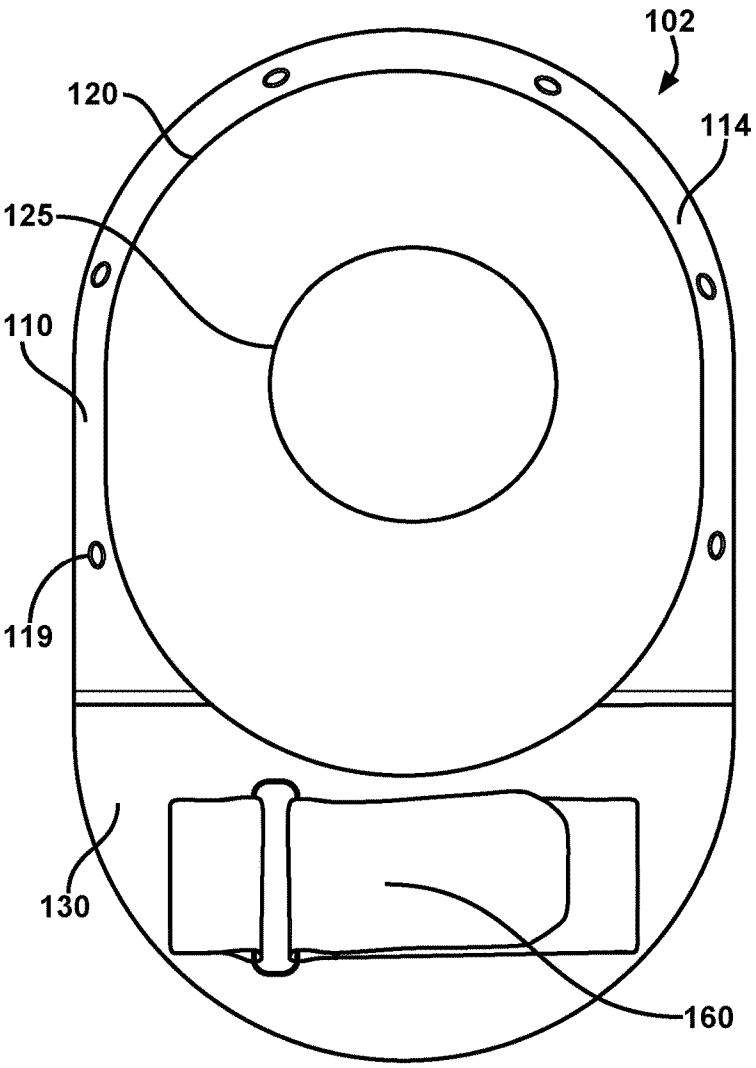
FIG. 9 is a plan view of a back side of a striking mitt.
Figure 11:
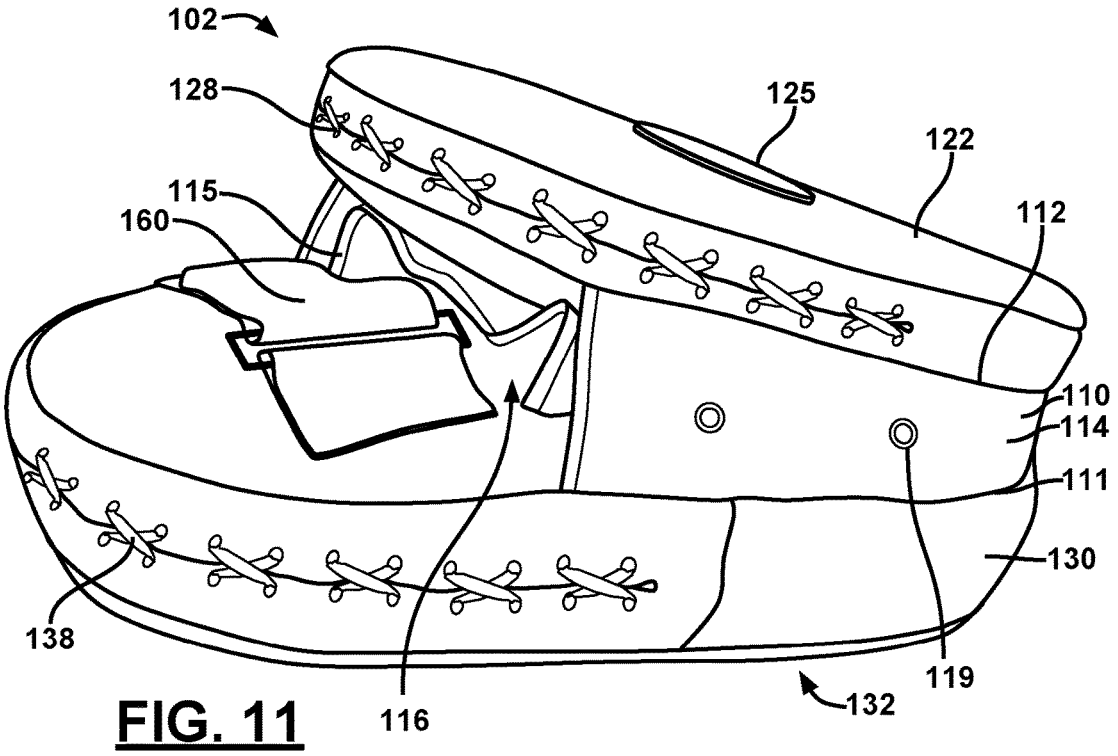
FIG. 11 is a first side perspective view of a striking mitt.
Figure 12:
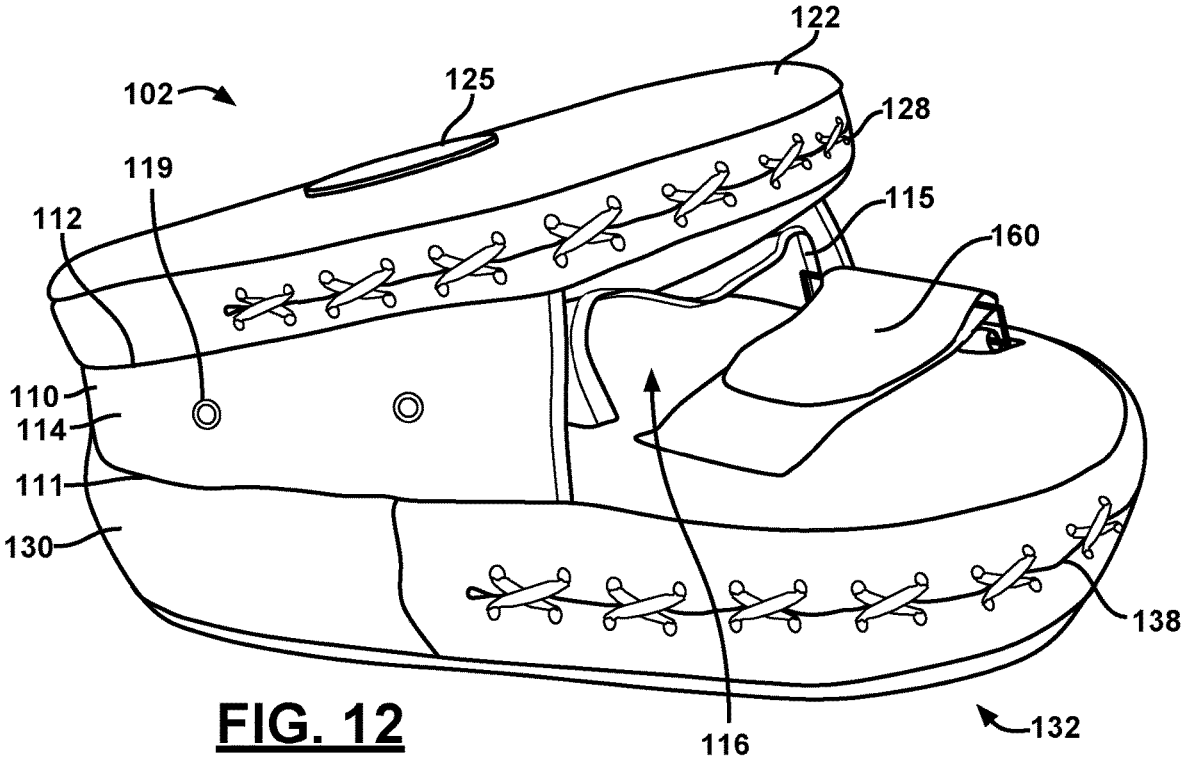
FIG. 12 is a second side perspective view of a striking mitt.

Turning to FIG. 7, some implementations may bring together a number of technologies into one striking mitt 100. Striking mitt 101 shown in FIG. 7 is substantially identical to striking mitt 100, the principal difference being that striking mitt 101 includes a stability ball 150 to aid the trainer in holding striking mitt 101 in place during use. The implementation depicted here may not only be a double-sided striking mitt 101, but it may also incorporate and include front target 135 and back target 125, a smaller-sized back pad 120, and an integrated stability ball 150 that allows a trainer to grip the glove assembly 110 better with his/her inserted hand to have more control.

Stability ball 150 may be a hemisphere or a slice of a ball, sphere, egg-shape, or other curvilinear surface that fits within a trainer's palm and/or fingers. The flat side (not shown) of the hemisphere or slice of the ball or egg shape of the stability ball 150 couples to the back side of the front pad 130 below the fingers or palm of glove 115. At the highest point of protrusion, the stability ball 150 may protrude from 0.2 to 1.7 inches away from the back side of the front pad 130 (e.g., 0.2"-1.5"; 0.2"-1.0"; 0.2"-0.8"; 0.4"-1.2"; or 0.4"-0.8"). The stability ball 150 may have a diameter between 0.8 to 4.5 inches on the back side of the front pad 130 (e.g., 0.8"-4.2"; 1"-3"; 1"-2"; 2"-4"; 1.5"-4"; or 1.5"-2.5"). Air cushioning technology may also be added to the padding of one or more of the front pad 130 and the back pad 120 to reduce the impact of a shot.

Referring now to FIGS. 8-12, the front pad 130 may have a sufficiently large shape to include a wrist strap 160. Striking mitt 102 shown in FIGS. 8-12 is substantially identical to striking mitt 100, the principal difference being that striking mitt 102 includes a wrist strap 160 and is larger to at least allow room for the wrist strap 160 and to provide a larger target and/or more protection for the trainer. Because of this, striking mitt 102 may not only be suitable for boxing applications, but it is also highly suitable for martial arts applications (e.g., TaeKwonDo, Karate, Muay Thai, kick-boxing, Mixed Martial Arts or "MMA", and so on) where kicking, kneeing, elbowing, and/or the like may be involved. The wrist strap 160 may be loosened to allow the trainer to insert a hand into the glove assembly 110, where the wrist strap 160 may then be tightened around the trainer's wrist. The wrist strap 160 may removably fasten using hook and loop fasteners, buckles, or other fastening members.

Figure 13:
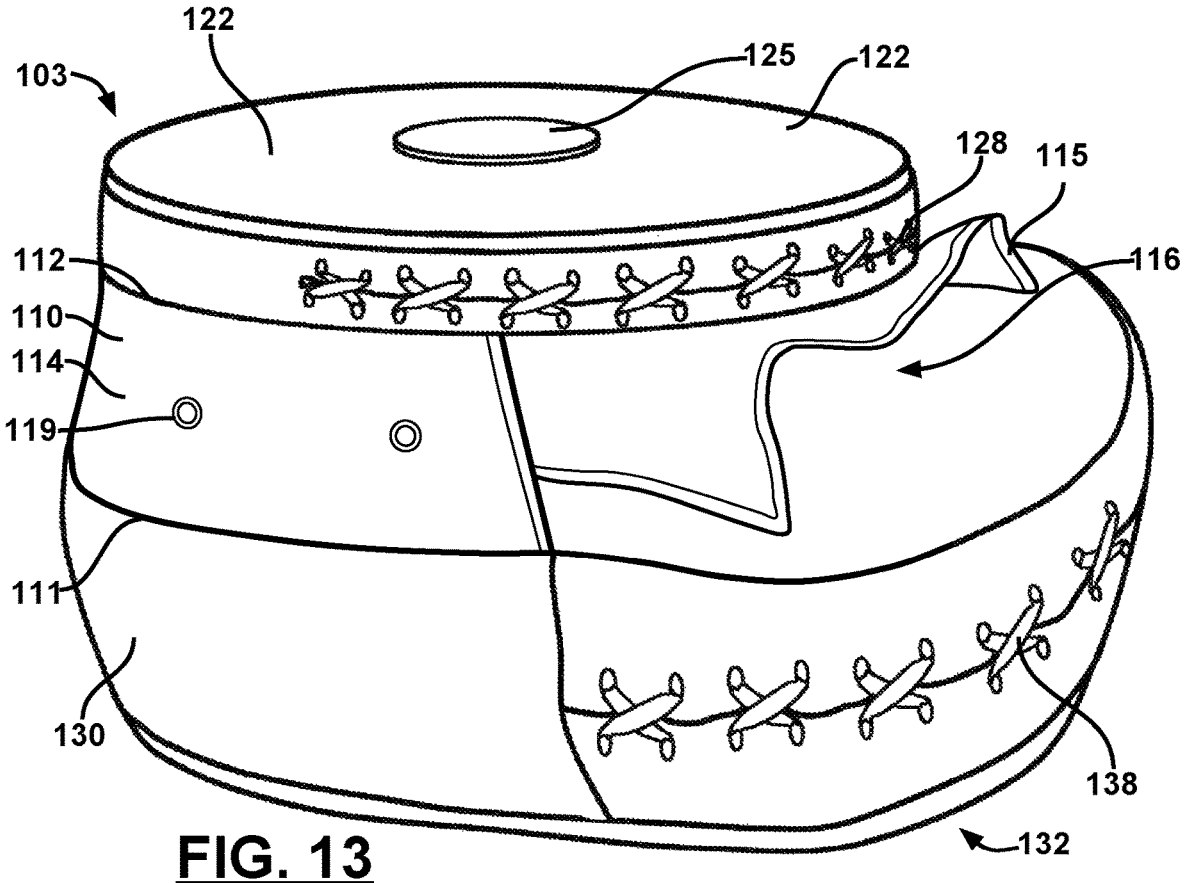
FIG. 13 is a side perspective view of a striking mitt.
Figure 14:
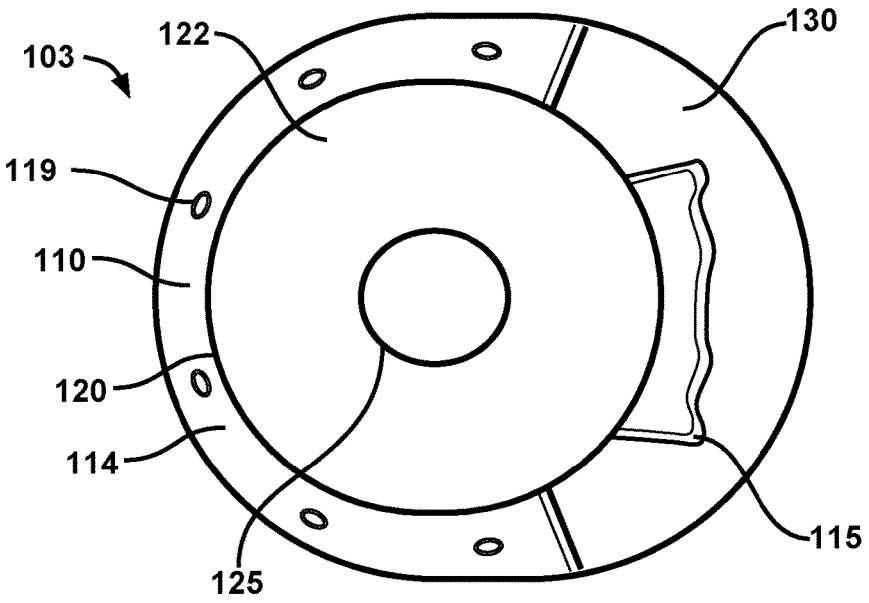
FIG. 14 is a plan view of a back side of a striking mitt.
Figure 17:
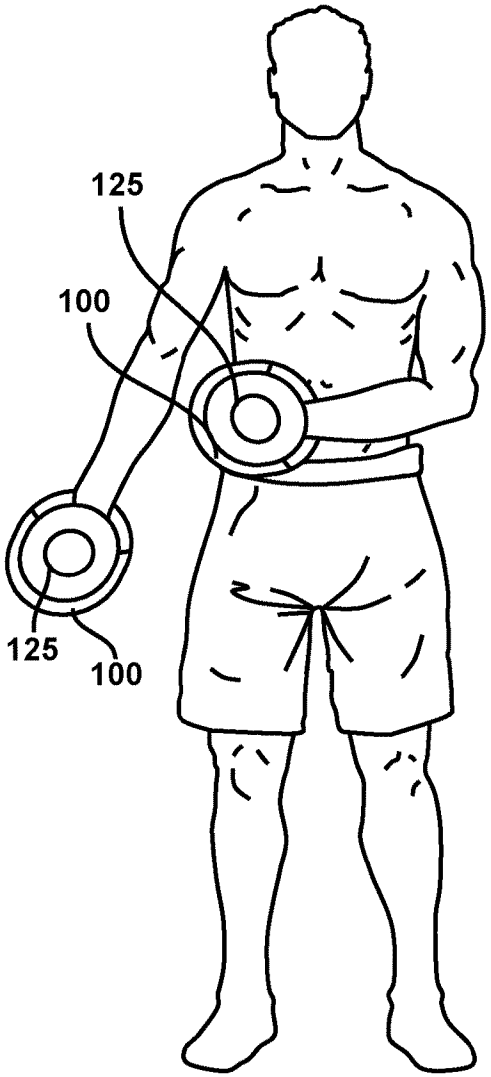
FIGS. 15-20 are front views of a pair of striking mitts in use by a trainer.
Figure 16:
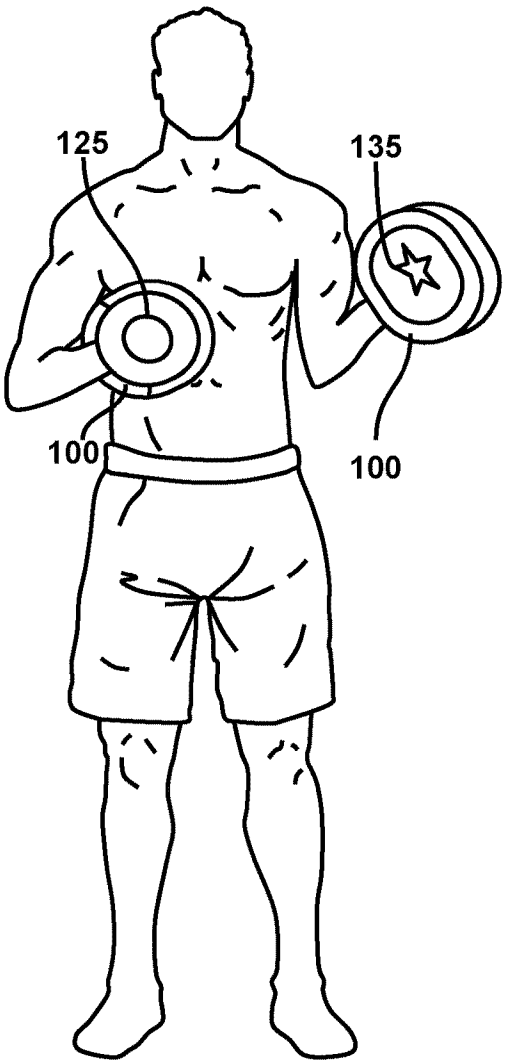
Figure 15:
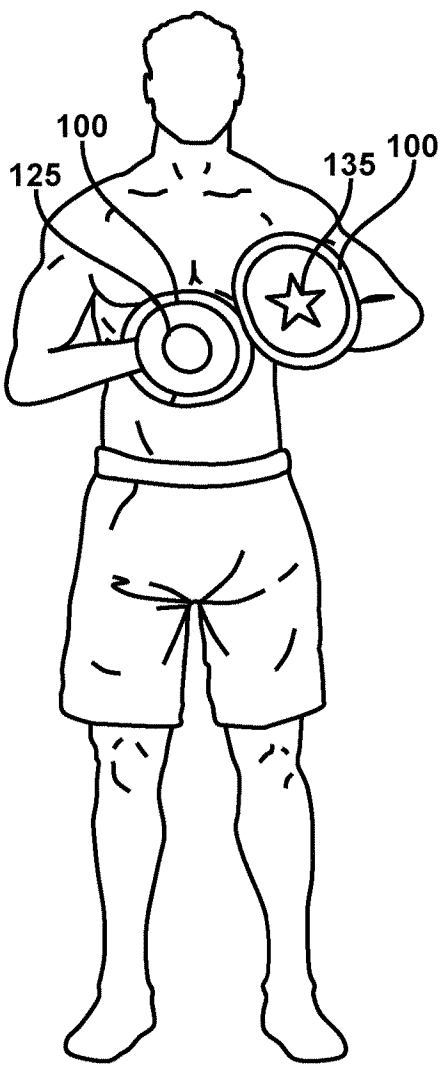

Referring now to FIGS. 13 and 14, the back pad 120 may be reduced in size to be similar to a "micro-mitt" size. Striking mitt 103 shown in FIGS. 13 and 14 is substantially identical to striking mitt 100, the principal difference being that striking mitt 102 uses a micro-mitt or reduced size back pad 120. Although not shown, any other components from other implementations, including a wrist strap 160 and/or a stability ball 150 for example, may be added to striking mitt 103. The back pad 120 of striking mitt 103 may be approximately 3 to 5 inches in diameter (e.g., 3"-4.8"; 3.5"-4.5"; 3"-4"; or 4"-5").

For the exemplary purposes of this disclosure, in one particular implementation of a striking mitt 100 the back pad 120 of the striking mitt 100 may be approximately 1.5 inches thick (e.g., 0.5 inches to 4.5 inches) and have a striking surface 122 diameter of approximately 6.5 inches (e.g., 4.5 inches to 8.5 inches). The front pad 130 of the striking mitt 100 may be similar to conventional striking mitts. For example, the front pad 130 may be approximately 2.5 inches thick (e.g., 0.5 inches to 4.5 inches), be approximately 11 inches in length (e.g., 8.0 inches to 22.0 inches), be approximately 8.0 inches in width at one end of its length (e.g., 6.0 inches to 12.0 inches), and be approximately 4.5 inches in width at an opposite end of its length (e.g., 3.0 inches to 8.0 inches).

For the exemplary purposes of this disclosure, in another particular implementation of a striking mitt 100 (including striking mitts 101, 102, and 103) the back pad 120 of the striking mitt 100 may be approximately 1.5 inches thick (e.g., 0.5 inches to 4.5 inches) and have a striking surface 122 diameter of approximately 6.5 inches (e.g., 4.5 inches to 8.5 inches). The front pad 130 of the striking mitt 100 may be similar to conventional striking mitts. For example, the front pad 130 may be approximately 2.5 inches thick (e.g., 0.5 inches to 4.5 inches), be approximately 11 inches in length (e.g., 8.0 inches to 22.0 inches) and be approximately 8.0 inches in width (e.g., 6.0 inches to 12.0 inches).

In some implementations of a striking mitt 100 (including striking mitts 101, 102, and 103), the back pad 120 of the striking mitt 100 may have a striking surface 122 with a length of approximately 8.5 inches (e.g., 6.5 inches to 10.5 inches) and a width of approximately 6.5 inches (e.g., 4.5 inches to 8.5 inches); while the front pad 130 of the striking mitt 100 may have a striking surface 132 with a length of approximately 11 inches (e.g., 8.0 inches to 22.0 inches) and a width of approximately 8 inches (e.g., 6.0 inches to 12.0 inches). In other implementations of a striking mitt 100 (including striking mitts 101, 102, and 103), the back pad 120 of the striking mitt 100 may have a striking surface 122 with a length of approximately 7 inches (e.g., 5.0 inches to 9.0 inches) and a width of approximately 6.5 inches (e.g., 4.5 inches to 9.0 inches); while the front pad 130 of the striking mitt 100 may have a striking surface 132 with a length of approximately 9 inches (e.g., 6.0 inches to 15.0 inches) and a width of approximately 8 inches (e.g., 6.0 inches to 14.0 inches). In further implementations of a striking mitt 100 (including striking mitts 101, 102, and 103), the back pad 120 of the striking mitt 100 may have a striking surface 122 with a length of approximately 5.5 inches (e.g., 3.5 inches to 8.0 inches) and a width of approximately 5.5 inches (e.g., 3.5 inches to 8.0 inches); while the front pad 130 of the striking mitt 100 may have a striking surface 132 with a length of approximately 6 inches (e.g., 4.0 inches to 9.0 inches) and a width of approximately 6 inches (e.g., 4.0 inches to 9.0 inches).

In some implementations, the striking mitt 100 (again, including striking mitts 101, 102, and 103) is sized and shaped for a particular sport. For example, a striking mitt 100 intended for use primarily in boxing may have one or both of the striking surfaces 132 and 122 smaller than a striking mitt 102 primarily intended for use in martial arts involving kicks that must be blocked. In some implementations, striking mitt 103 using a micro-mitt may primarily be limited to use in boxing or other sports not involving kicks. In some implementations, striking mitt 100 is sized and shaped smaller than striking mitt 102, and striking mitt 100 is primarily limited to use in boxing or other sports not involving kicks. In certain implementations, striking mitt 100 is sized and shaped sufficiently large to be used to catch kicks, while striking mitt 102 may be sized and shaped smaller such that striking mitt 102 is limited to use in boxing or other sports not involving kicks. Any one of striking mitts 100, 101, 102, or 103 may be sized and shaped to handle multiple sports (with or without kicks) or just a single sport (with or without kicks).

In some implementations the area of the striking surface 122 of the back pad 120 is smaller than the area of the striking surface 132 of the front pad 130 and may be similar in size to what is called a micro mitt. The area of the striking surface 122 of the back pad 120 may be between 100% and 40% the size of the area of the striking surface 132 of the front pad 130 (e.g., between: 90% and 40%, 99% and 80%, 80% and 50%, 80% and 40%, 75% and 60%, and so forth). The front pad 130 and/or back pad 120 include a padding material (e.g., padding, foam, cotton, plastics, composites, gel, etc.) and/or an air system configured to cushion and reduce the force of a strike felt by the trainer wearing the striking mitt 100.

In certain implementations, all or part of the striking mitt (e.g., back pad 120, front pad 130, glove assembly 110, etc.) may be flexible or rigid and be primarily constructed of one or more of the following materials: natural or synthetic leather, polymer fabric, nylon, natural or synthetic leather, carbon fiber, metal, canvas, plastic, rubber, any material used in conventional striking mitts, or similar materials. These materials may couple together or to other elements in various ways, including but not limited to with: adhesives, stitching, bonding agents, crimping, welding, taping, gluing, cementing, magnets, heat bonding, lashings, grommets, fasteners, ties, clips, staples, and so forth.

As depicted in the non-limiting implementations shown of FIGS. 15-22, a striking mitt device or system 100 or 102 provides improved variability in the location, angle, and variety of strikes the trainer can catch with the striking mitt 100 or 102. The disclosed striking mitt 100 or 102 allows the trainer the ability to choose to catch the athlete's strikes with either the front pad 130 or the back pad 120 of the striking mitt.

Figure 20:
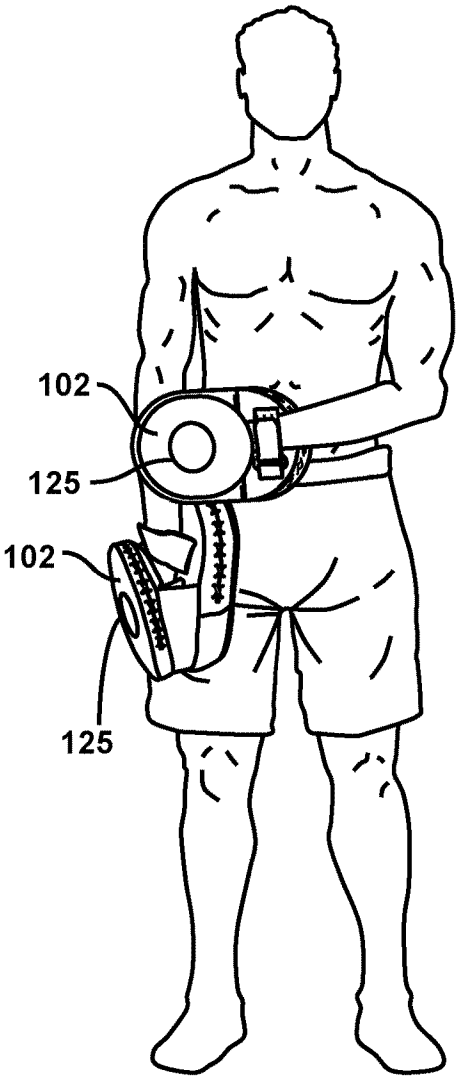
Figure 19:
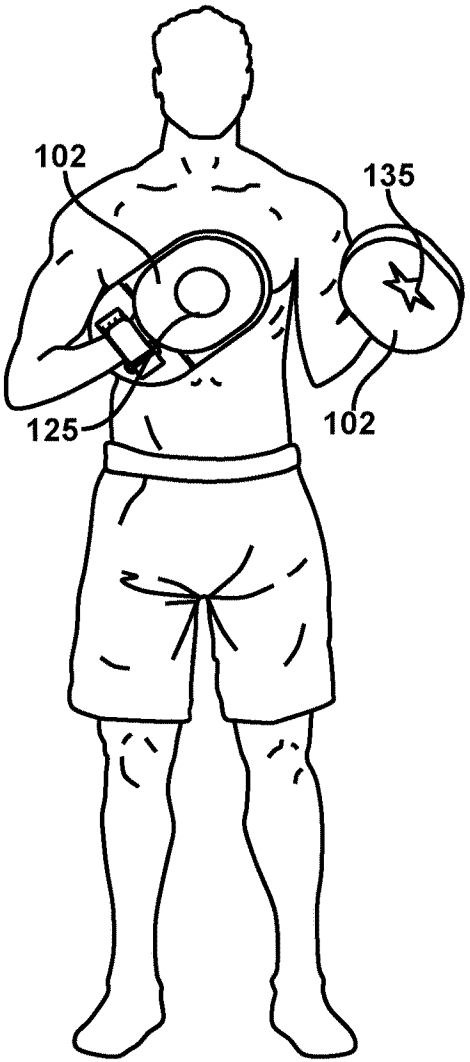
Figure 18:
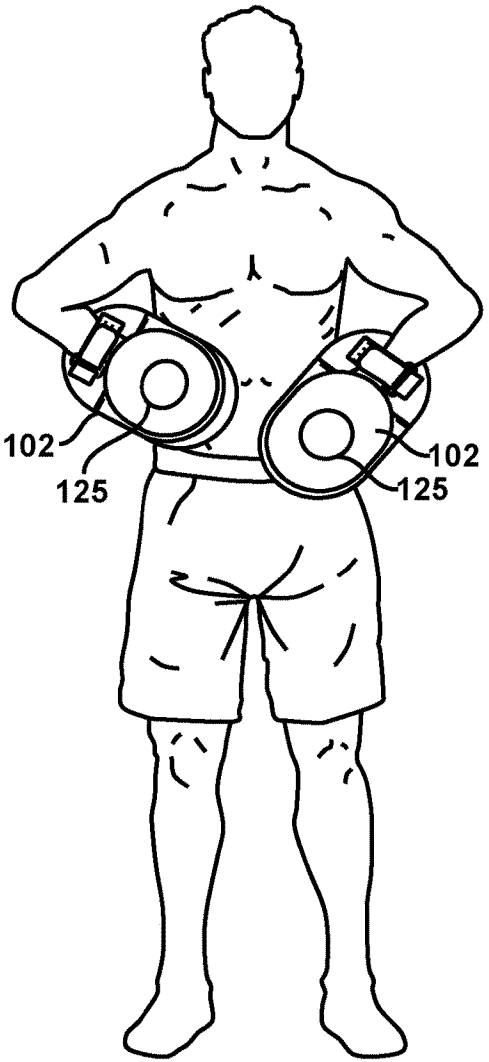
Figure 22:
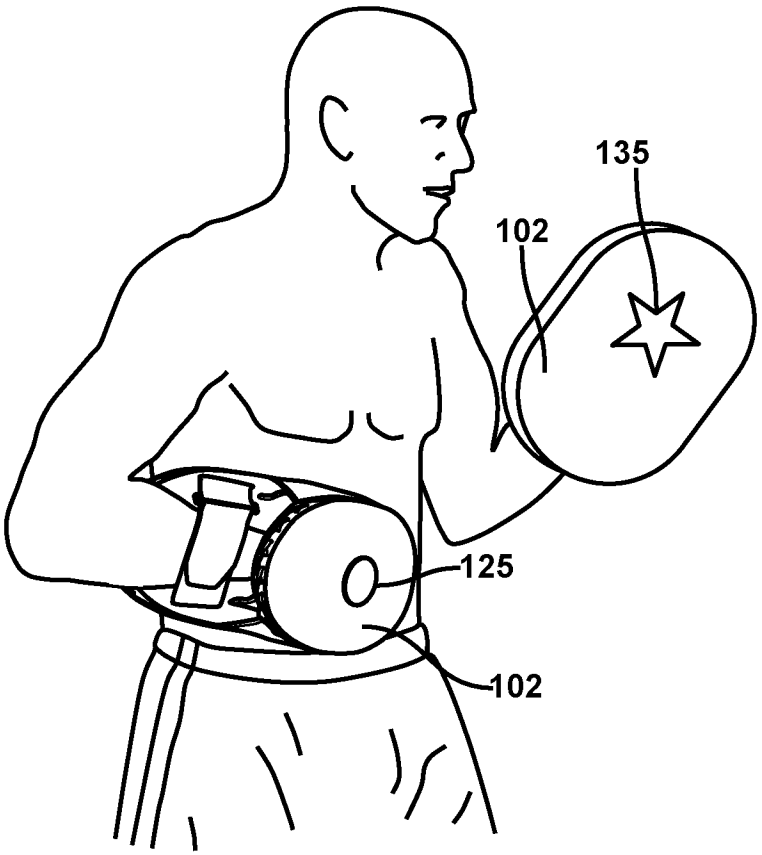
FIGS. 21 and 22 are three-quarter side perspective views of a pair of striking mitts in use by a trainer.
Figure 21:
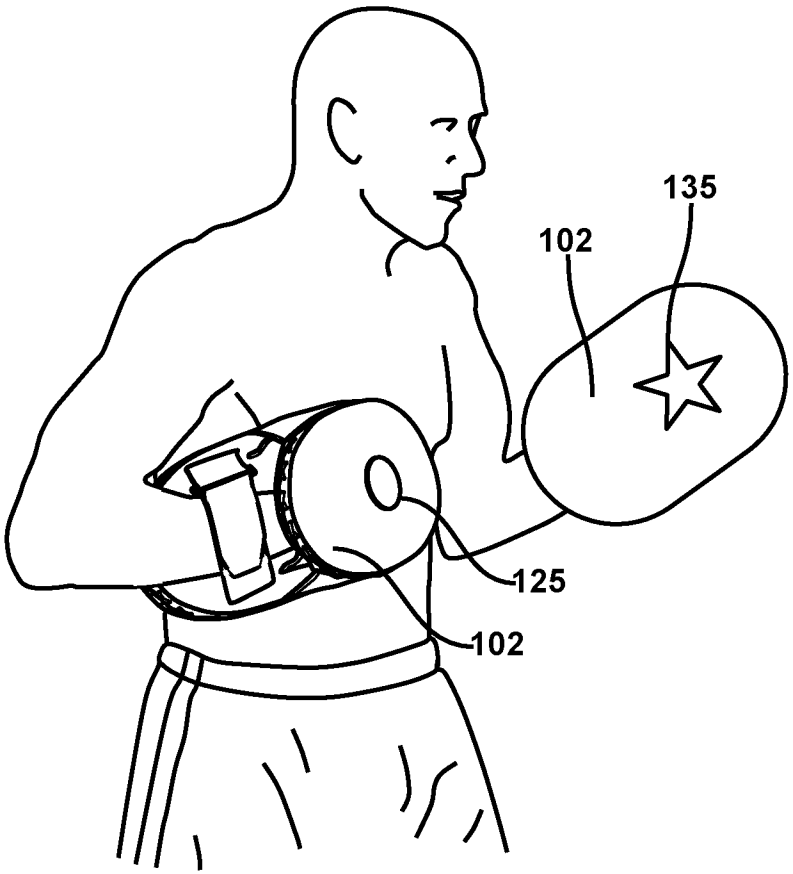

In boxing training, for example, the trainer may catch a liver shot (a type of body shot punch) using the front pad 130 or using the back pad 120 (as shown in FIGS. 18 and 20). Previously, conventional focus mitts could only catch a liver shot in a contorted position requiring the trainer to twist the arm, place the back of the left hand against and below the right elbow, thereby facing the front face of the focus mitt downward to catch the liver shot. Catching a liver shot with the back pad 120 of the striking mitt as shown in FIGS. 18 and 20 provides a more accurate simulation of an actual liver shot and the risk of injury to the trainer is lowered because this position creates a better wrist, forearm, elbow, and shoulder pronation and flexion.

Thus, the athlete may obtain more accurate simulated strikes and the trainer is less likely to injure himself by not being forced to contort his arm into injury-prone angles (by pronating, flexing, or torqueing the arm or shoulder into weaker or injury-prone positions). Repetitive stress to joints of the arm and shoulder through flexed or pronated wrist, forearm, elbow, and shoulder present a significant danger to trainers. The disclosed striking mitts greatly reduce the risk of acute or chronic injury to the trainer by providing greater flexibility in positioning the striking mitt to create safer arm positions for the trainer.

FIGS. 15-17, 19, 21 and 22 depict additional exemplary views of a trainer positioning the back pad 120 and front pad 130 of a striking mitt to catch the athlete's strikes (shown as various shots).

There are obviously many, many more positions a trainer could place the striking mitts 100, 101, 102, 103, and the like. The trainer may vary the use of the back pad 120 and the front pad 130 depending on preference, reduced injury risk, athlete preference, athlete ability, athlete size or stature, and/or the like. The athlete may strike either the front pad 130 or the back pad 120 of the striking mitt when the striking mitt is positioned away from the trainer's torso or other member of the trainer's body, such as a leg, a head, and the like, and does not necessarily need to be struck when the striking mitt is touching the trainer's torso or other body part. For example, the trainer could hold his hands down by his side for a smaller athlete and not have to squat down or be on his knees contorting his arms. The trainer may choose to use two striking mitts (one on each hand) or elect to use just one striking mitt.

In places where the description above refers to particular implementations of athletic striking mitts, it should be readily apparent that a number of modifications may be made without departing from the spirit thereof and that these implementations may be applied to other striking mitts in different fields and applications. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

What is claimed is:

1. A striking mitt comprising:

a front pad having an outwardly facing front surface and an inwardly facing inner surface, and the front pad comprising an opening and a fastening mechanism, the opening and the fastening mechanism positioned in-between the front surface and the inner surface of the front pad, through which a padding material is inserted and enclosed in-between the front surface and the inner surface of the front pad, and the opening releasably closed by the fastening mechanism;

a back pad entirely separated from the front pad by a gap, the back pad having an outwardly facing back surface and an inwardly facing inner surface, and the back pad comprising an opening and a fastening mechanism, the opening and the fastening mechanism positioned in-between the back surface and the inner surface of the back pad, through which a padding material is inserted and enclosed in-between the back surface and the inner surface of the back pad, and the opening releasably closed by the fastening mechanism, wherein a surface area of the back surface is smaller than a surface area of the front surface, wherein the back pad is thinner than the front pad, a glove body in-between the front pad and the back pad, a webbing directly attached to the front pad and the back pad and spanning the gap between the front pad and the back pad and entirely separating the front pad from the back pad, and an adjustable wrist strap directly attached to the inner surface of the front pad and entirely spaced apart from and entirely below the glove.

2. The striking mitt of claim 1, wherein the glove body is solely attached to the front pad.

3. The striking mitt of claim 1, wherein the surface area of the back surface is between 50% and 80% as large as the surface area of the front surface.

4. The striking mitt of claim 1, wherein the front pad is at least 2.5 inches thick and the back pad is at least 1.5 inches thick.

5. The striking mitt of claim 1, wherein the striking mitt further comprises:

a protrusion beneath a palm or finger portion of the glove, the protrusion protruding from the inner surface of the front pad and towards the back pad, wherein the protrusion has a diameter of between 0.8 and 4.5 inches and a maximum height between 0.2 and 1.7 inches.

* * * * *